US005568228A

United States Patent [19]

Tombs

[11] Patent Number: 5,568,228

[45] Date of Patent: Oct. 22, 1996

[54] IMAGE FORMING APPARATUS WITH CONTROLLED TRANSFER

[75] Inventor: Thomas N. Tombs, Brockport, N.Y.

[73] Assignee: Eastman Kodak Company, Rochester, N.Y.

[21] Appl. No.: 355,579

[22] Filed: Dec. 14, 1994

[51] Int. Cl.[6] ..... G03G 21/00

[52] U.S. Cl. ..... 355/208; 355/273; 355/274

[58] Field of Search ..... 355/208, 271, 355/273, 274, 277

[56] References Cited

U.S. PATENT DOCUMENTS

| | | | |
|---|---|---|---|
| 3,684,362 | 8/1972 | Weigl . | |
| 3,707,138 | 12/1972 | Cartwright . | |
| 3,734,724 | 5/1973 | York . | |
| 3,781,105 | 12/1973 | Meagher . | |
| 4,014,605 | 3/1977 | Fletcher . | |
| 4,348,098 | 9/1982 | Koizumi | 355/277 X |
| 5,036,360 | 7/1991 | Paxon et al. | 355/208 |
| 5,084,737 | 1/1992 | Hagen et al. | 355/274 |
| 5,287,144 | 2/1994 | Takeda | 355/208 |
| 5,291,253 | 3/1994 | Kumasaki et al. | 355/275 |
| 5,361,125 | 11/1994 | Fletcher | 355/271 |

*Primary Examiner*—Robert Beatty
*Attorney, Agent, or Firm*—Leonard W. Treash, Jr.

[57] ABSTRACT

An image forming apparatus includes a transfer station having a transfer member and an erasing irradiation source. Variations in resistance of the transfer member due to relative humidity, age or the like, or of the receiving sheet are compensated for by adjusting the irradiation source to maintain consistency in the response time of the transfer field.

12 Claims, 1 Drawing Sheet

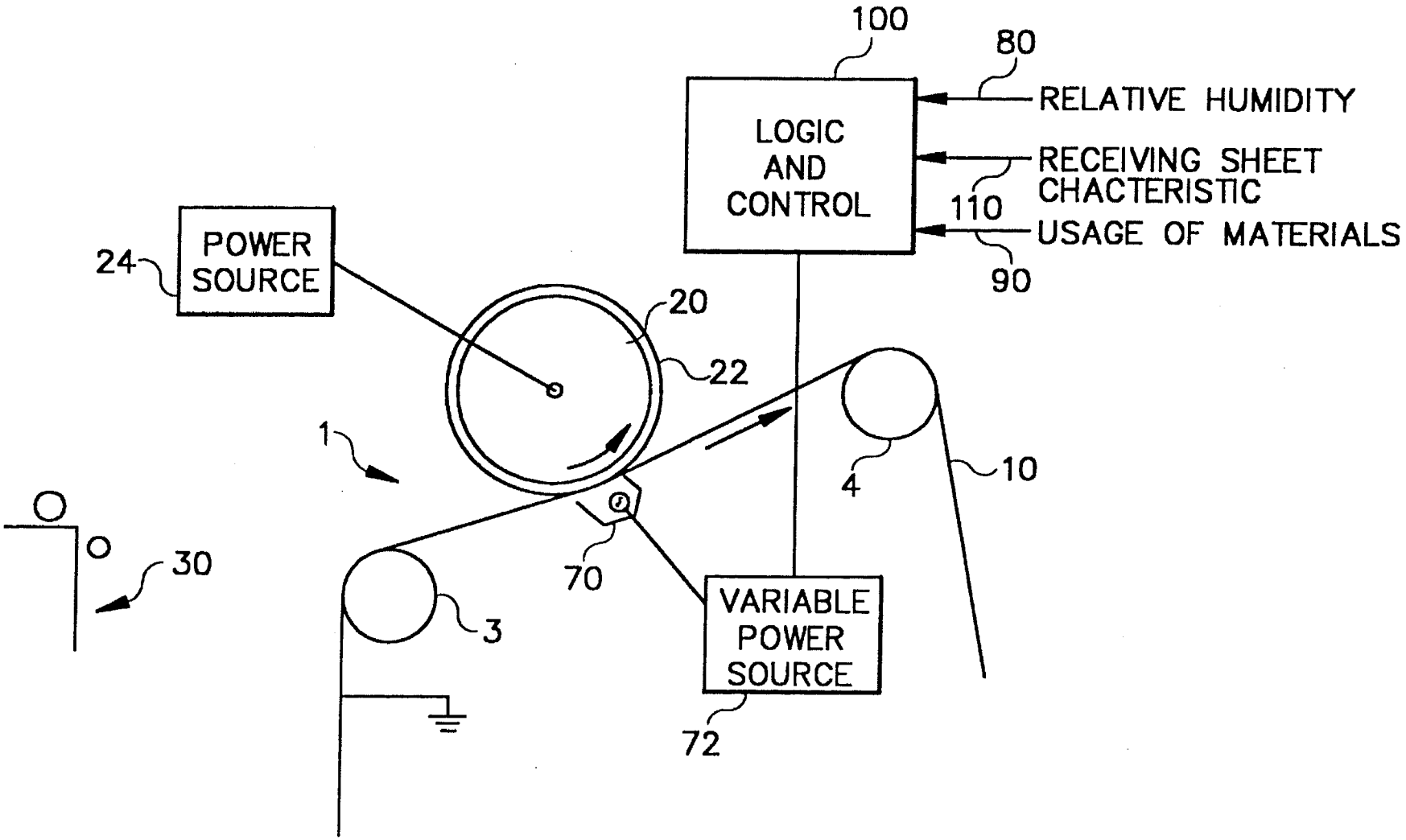
RELATIVE HUMIDITY
RECEIVING SHEET CHACTERISTIC
USAGE OF MATERIALS
80
110
90
100
LOGIC AND CONTROL
10
4
VARIABLE POWER SOURCE
72
20
22
70
3
1
POWER SOURCE
24
30

IMAGE FORMING APPARATUS WITH CONTROLLED TRANSFER

CROSS-REFERENCE TO RELATED APPLICATIONS

This application relates to co-filed U.S. application Ser. No. 08/355,774, filed Dec. 14, 1994, IMAGE FORMING APPARATUS WITH A TRANSFER STATION ERASE, Thomas N. Tombs.

BACKGROUND OF THE INVENTION

This invention relates to the transfer of toner images. More specifically, it relates to an image forming apparatus in which the transfer of a toner image to a receiving surface, either of a receiving sheet or an intermediate member is controlled in varying ambient conditions.

U.S. Pat. No. 3,781,105 to Meagher, issued Dec. 25, 1973, suggests a multilayered transfer backing roller having intermediate conductivity. More recently, typical backing members having a polyurethane blanket with a resistivity of $1\times10^9$ ohm-cm at 70° F. and 50 percent relative humidity are used to control ionization in both the pre-nip and post-nip regions.

However, the resistivity of intermediate conductivity materials is not stable over a typical range of operating temperatures and humidities and also changes somewhat as the roller ages. Variations in the resistivity of rollers alter the response time of the transfer subsystem, i.e., the rate at which the electric field increases and decreases as the image traverses the nip. Such variation results in a less robust subsystem because of image quality degradation in the form of ionization defects and reduced transfer efficiency. Although somewhat different in degree, these effects exist both with conventional transfer directly to a receiving sheet backed by a transfer member of intermediate conductivity and with transfer directly to a transfer member that functions as an intermediate. Although rollers are typically used as both backing members and intermediate members, belts and other configurations for such transfer members are also used.

U.S. Pat. No. 5,084,737 to Hagen et al also notes that an increase in humidity causes moisture to be absorbed by polyurethane or other material substance being used for the intermediate conductivity layer (blanket) on a transfer drum. It notes that the electrical properties of the structure between the core of the polyurethane layer and the conductive backing on the original image member can be modeled by a simple RC circuit. The time required for the transfer field to reach full application varies according to the resistance of the polyurethane layer. In this particular instance, the transfer field was applied only after the initial portion of a receiving sheet is held by a vacuum. The response time of the system, thus, is critical. The solution to varying conditions in this reference is to vary the time of application of the field as a function of the relative humidity or the resistance of the transfer drum. A constant current source is used to create the transfer field. Relative humidity is determined for use in adjusting the field by sensing the voltage applied by the constant current source. See also, U.S. Pat. No. 5,036,360 to J. F. Paxon et al, issued Jul. 30, 1991.

U.S. Pat. No. 4,014,605, issued to Fletcher Mar. 29, 1977, is one of a number of references that suggests use of an erase lamp during transfer when one of the components in the transfer process includes a photoconductive layer. It especially suggests erasing in the post-nip region. See also, U.S. Pats. 3,734,724 to York, issued May 22, 1973; 3,707,138 to Cartwright, issued Dec. 26, 1972; and 3,684,362 to Weigl, issued Aug. 15, 1972.

SUMMARY OF THE INVENTION

The electric field in the transfer nip increases as the image passes through the nip when an intermediate conductivity transfer roller is employed. The response time of the electric field is determined by several parameters (resistance and capacitances are per unit area): the resistivity of the roller $\rho_r$, the capacitance of the roller $C_r$, the thickness of the roller blanket $d_r$, the capacitance of the photoconductor film $C_f$, the capacitance of the toner stack $C_t$, the resistance of the paper $R_p$, the capacitance of the paper $C_p$, and the air gap spacing between the toner and paper in all areas of the nip $d_g$ (or between the paper and transfer roller or between the toner and intermediate member, depending on the configuration). Consider the configuration of transfer from a photoconductor to an intermediate roller—the simplest configuration because no paper is involved. By solving the equivalent lumped parameter circuit, the response time $\tau$ is approximated by:

$$\tau=p_r d_r(C_r+1/(d_g/\epsilon_o+1/C_f+1/C_t))$$

where $\epsilon_o$ is the permittivity of free space and equals $8.854\times10^{12}$ F/m.

The above equation indicates that the response time depends on the capacitance of the film. Therefore, the response time can be altered by erasing the film during transfer.

It is an object of the invention to improve the transfer of a toner image to a receiving surface in a system subject to variable conditions, for example, variations in the resistance of a transfer member or a receiving sheet.

This and other objects are accomplished by actively controlling the radiation level of an erase radiation source directed in the nip area in response to changing conditions, such as humidity or transfer member usage or change in type or thickness of a receiving sheet. By doing this, the response time of the transfer system can be adjusted to compensate for changes in transfer member resistivity or receiving sheet resistance.

According to a preferred embodiment, an image forming apparatus has an image member having a photoconductive layer and a conductive layer on a transparent support. A transfer station is positioned to transfer a toner image carried by the image member to a transfer surface of a transfer member or a receiving sheet backed by the transfer member. The image forming apparatus also includes logic and control for controlling operation of the transfer station. The transfer station includes a transfer member having a layer of intermediate conductivity that varies with ambient relative humidity or other conditions. The transfer member is positioned to support or define the transfer surface facing the image member. The transfer station also includes means for applying an electric field between the layer of intermediate conductivity and the conductive backing, which field has a direction urging transfer of a toner image from the image member to the receiving surface. An irradiating means is positioned to irradiate the photoconductive layer with radiation where the photoconductive layer faces the layer of intermediate conductivity..

The logic and control includes means for receiving an input indicative of the resistance of the layer of intermediate resistance and means for adjusting the irradiating means in response to the input.

According to another preferred embodiment, the logic and control includes means for receiving an input indicative of the resistance of a receiving sheet. For example, it can receive an input that transparency stock is being used, that paper of a particular thickness is being used and/or an input indicative of the relative humidity. As in the other embodiment, the erasing radiation source is adjustable to adjust the response time of the transfer system to compensate for a change in resistance of the receiving sheet.

Using the preferred embodiments, the response time of a transfer system can be held more constant in variable conditions. This provides more transfer latitude and greater efficiency over a range of conditions.

BRIEF DESCRIPTION OF THE DRAWINGS

The drawing is a side schematic of the transfer portion of an image forming apparatus.

DETAILED DESCRIPTION OF THE INVENTION

According to the invention, in an electrophotographic or similar image forming apparatus changes in transfer member resistivity or receiving sheet resistance are immediately compensated for by including an in-nip erase radiation source in a process control algorithm. The process control includes a device that measures a response which correlates reasonably well with changes in transfer member resistivity or receiving sheet resistance. The drawing illustrates this approach.

According to the drawing, an image forming apparatus includes an image member 10 which is supported by a number of rollers, including rollers 3 and 4 for movement through an endless path through a series of stations. The stations can include a charging station, an exposing station and a toning station to electrophotographically create a toner image on the outside surface of image member 10. Typical image members for use in an electrophotographic system include one or more photoconductive layers with a conductive backing which is generally grounded. The conductive backing and the photoconductive layers are often coated on a transparent support.

As the image member 10 is moved from roller 3 to roller 4, it passes through a transfer station 1 defined, in part, by transfer member 20. Transfer member 20 is shown as a roller or drum which has a blanket 22 which may be compliant. Blanket 22 is typically of a polyurethane or similar material which has been doped with enough antistat material to make it somewhat conductive, for example, it may have a resistance of $1 \times 10^9$ ohm-cm. This intermediate resistance or conductivity allows the imposition of an electric field between it and the conductive backing on image member 10 while minimizing pre-nip and post-nip ionization as would occur with a very conductive or very resistive roller. The term "intermediate conductivity" includes anything with resistivity greater than $10_5$ ohm-cm but with still sufficient conductivity to support an electric field, for example, $10^{12}$ ohm-cm. For some applications, the intermediate conductivity blanket is covered by a very thin layer of a somewhat harder material. This harder "skin" helps transfer from the transfer member if it is used as an intermediate and helps in cleanliness of the transfer member if it is used as a backing member. It is typically so thin that it has little bearing on the function described herein.

When transfer is to a receiving sheet, the receiving sheet is fed from a receiving sheet supply 30 and onto the surface of image member 10 in advance of the transfer station 1. The receiving sheet then passes through a nip formed by the transfer member 20 and image member 10. An electric field is created by a power source 24 which is of a direction to urge the charged particles that make up the toner image to transfer to the transfer surface of the receiving sheet. The receiving sheet is then separated from image member 10 and transported to a fixing device such as a fuser, not shown, for fixing of the toner image to the receiving sheet. Alternatively, the receiving sheet is attached to the transfer member 20. This allows the sheet to be recirculated through the transfer station to pick up more than one image in registration, for example, to form a multicolor image on the sheet.

If transfer is to transfer member 20, no receiving sheet is fed into the nip between transfer member 20 and image member 10 and the field is, again, of a direction urging transfer to the transfer surface on transfer member 20. The toner image is then transferred by means not shown to a receiving sheet at a position generally remote from image member 10. It can also be transferred back to image member 10 in registration with another image to form a two toner image, for example, a two color image. It can also be transferred to the opposite side of a sheet that may be receiving an image on the frontside of the sheet, again, in the nip between image member 10 and transfer member 20. All of these options for use of intermediate transfer are known in the art.

A power source 24 applies a bias to transfer member 20 which creates a field between blanket 22 and the conductive backing of image member 10, which is generally grounded, as shown in the drawing. Power source 24 can be any power source known in the art, including a constant voltage source. However, a constant current source is preferred, especially for transferring to a transfer surface of a receiving sheet fed from receiving sheet supply 30. If a constant current source is used, the voltage applied can be monitored and, from it, the resistance of blanket 22 determined. Similarly, if a constant voltage source is used, then the current applied can be monitored and, again, the resistance of blanket 22 determined. That resistance value is fed from power source 24 to logic and control 100.

An erase lamp 70 is positioned behind image member 10 in transfer station 1. Erase lamp 70 is positioned to irradiate the photoconductive layer in image member 10 through both the conductive layer and the transparent support. The irradiation from radiation source 70 is of a wavelength to which the photoconductive layer is sensitive. Referring to the equation set out above, an alteration in the conductivity of the photoconductive layer affects the response time of the field in the transfer nip. This same response time is affected by a change in the resistance of blanket 22.

According to the one embodiment of invention, the amount of irradiation from erase lamp 70 is varied to compensate for the variation in the resistivity of blanket 22 to make less variable the response time of the field. To accomplish this, a variable power source 72 controls the irradiation from radiation source 70. Variable power source 72 is controlled by logic and control 100 which has received an input from power source 24 or another sensor which correlates with the resistance of blanket 22.

An example of using a radiation source to compensate for variation in roller resistivity uses an intermediate transfer system with $\rho_r=2\times10^9$ ohm-cm, $C_r=11.51$ nF/m$^2$, $d_r=5$ mm, $d_g=0.1$ μm (in the nip), $C_f=1.417$ μF/m$^2$, and $C_t=1.505$ $\mu F/m^2$. With no erase, the response time of a transfer subsystem in the nip is 73.7 milliseconds. If the resistivity ($\rho_r$) of the roller decreases to $10^9$ ohm-cm (due, for example, to an increase in relative humidity), then the response time changes to 36.8 milliseconds. By erasing the photoconductor in the nip, the response time increases to 74.6 milliseconds, thereby compensating for the change in roller resistivity. Decreasing the capacitance of the photoconductor (by increasing the thickness) or increasing the capacitance of the toner layer (by decreasing the stack height) allows for a larger change in the response time with the in-nip radiation source.

A rough improvement in performance can be obtained by a straight on and off erase lamp which is responsive to a particular threshold of resistivity of blanket 22. Preferably, with a moderate contrast photoconductor, a series of levels of erasing radiation is used for a continuous change in radiation level according to resistivity.

In electrophotographic image forming apparatus such as that shown in the drawing, changes in transfer member resistivity are immediately compensated for by including the erase source in a process control algorithm. The process control includes a device that measures a response which correlates reasonably with changes in transfer member resistance or blanket resistivity. Although the direct measure of transfer member resistance is the input described above, indirect measures may also be applied, such as measuring the density of a transfer control patch or its residual. Similarly, the relative humidity change can be directly measured and input as shown at 80. The adjustment of the erasing radiation can be made during cycle up or between images, depending on the need to adjust for rapidly changing conditions.

This invention is particularly suited to transfer systems that employ intermediate conductivity transfer members that yield system time constants in the nip which are comparable to the resident time, where the resident time is the nip width divided by the process speed. For typical electrophotographic devices, this corresponds to blanket resistivities in the range of $10^8$ to $10^{10}$ ohm-cm for a roller having a blanket thickness between 0.1 cm and 3 cm. However, lower or higher resistivities will also find some use for this approach.

According to another preferred embodiment, changes in receiving sheet resistance can also be compensated for in addition to or together with changes in transfer member resistivity. It is common for a logic and control to have information indicative of the resistance of the receiving sheet. For example, the use of transparency stock is often optically sensed or input by an operator to allow adjustment of the apparatus for it as shown at 110. The thickness of paper can also be input which, with a humidity input as described above, can be used to determine paper resistance. With these inputs, logic and control 100 adjusts variable power source 72 for the resistance of the receiving sheet being used.

Aging of the transfer member, or of the photoconductive member can be calculated by the logic and control and is commonly done in order to determine replacement of components. This information can also be used to adjust the erasing irradiation, and is shown input to the logic and control 100 at 90.

Note in the drawing that erasing radiation is baffled from the post-nip area but allowed to fall in the pre-nip area. This provides further latitude to the transfer system by increasing the time constant or response time of the field in the pre-nip area which inhibits pre-nip ionization while increasing the response time in the post-nip area which also inhibits post-nip ionization. This approach is preferred to prior art erase lamps in which both post-nip and pre-nip were baffled or which included a baffle only of the pre-nip area. It is the subject of my co-filed application, U.S. Ser. No.08/355,774, entitled "IMAGE FORMING APPARATUS WITH A TRANSFER STATION ERASE." The invention can be applied whether or not a baffle is used in either position.

A photoconductive layer could be included on the transfer roller and the erasing radiation made through it. However, the availability of intermediate conductivity materials that are transparent is somewhat limited. Since the film in electrophotographic machines already has a photoconductive layer, that approach is preferred.

The invention has been described in detail with particular reference to a preferred embodiment thereof, but it will be understood that variations and modifications can be effected within the spirit and scope of the invention as described hereinabove and as defined in the appended claims.

I claim:

1. Image forming apparatus having an image member having a photoconductive layer and a conductive layer on a transparent support, a transfer station positioned to transfer a toner image carried by the image member to a transfer surface of a transfer member or a receiving sheet backed by the transfer member, and a logic and control for controlling operation of the image forming apparatus, said transfer station including, a transfer member having a layer of intermediate resistivity, which resistivity varies, the transfer member being positioned to support the transfer surface facing the image member, means for applying an electrical field between the layer of intermediate resistivity and the conductive backing of the image member, which field is of a direction urging transfer of a toner image from the image member to the transfer surface, means for irradiating the photoconductive layer at a position at which it faces the transfer surface, said logic and control including, means for receiving an input indicative of the resistivity of the layer of the transfer member, and means for adjusting the means for irradiating in response to said input.

2. Image forming apparatus according to claim 1 wherein the transfer station includes a constant current power source and means for monitoring the potential applied by the power source and for inputting the amount of that potential to the logic and control for determination of the resistivity of the layer of the transfer member.

3. Image forming apparatus according to claim 1 wherein the transfer station includes a constant voltage power source and means for monitoring the current applied by the power source and for inputting the amount of that current to the logic and control for determination of the resistivity of the layer of the transfer member.

4. Image forming apparatus according to claim 1 wherein said logic and control includes means for receiving inputs of one or both relative humidity and usage of components and means for determining the resistivity of the layer of the transfer member from said input or inputs.

5. Image forming apparatus according to claim 1 wherein said means for irradiating is variable between only on and off conditions and wherein said logic and control includes means for adjusting the on or off condition of the irradiating means according to whether said transfer member resistivity is above or below a predetermined threshold.

6. Image forming apparatus according to claim 1 wherein said means for irradiating is adjustable between a plurality of on conditions of different radiation amounts.

7. Image forming apparatus according to claim 1 further including means for feeding a receiving sheet into a position between said image member and said transfer member with a side of the receiving sheet facing the image member defining the transfer surface to which the toner image is transferred.

8. Image forming apparatus according to claim 1 wherein said transfer member is an intermediate member for receiving a toner image directly onto its surface, which surface is the transfer surface.

9. Image forming apparatus according to claim 7 wherein said logic and control also includes means for receiving an input indicative of the resistance of the receiving sheet and means for adjusting the means for irradiating in response to input.

10. A method of transferring, in a transfer nip, a toner image from an image member to a transfer surface associated with a transfer member whose resistivity varies with relative humidity, age or manufacturing variation, either the image member or the transfer member having a photoconductive layer, said method comprising:

determining the resistivity of the transfer member, irradiating said photoconductive layer in said transfer nip, and adjusting the amount of the irradiation according to the determined resistivity of the transfer member.

11. Image forming apparatus having an image member for carrying a toner image and a transfer member for cooperating with the image member to create an electric field for transfer of the toner image to a transfer surface, one of said image member or said transfer member having a photoconductive layer, and one of the members having an insulating layer whose resistance varies with ambient conditions, said image forming apparatus further including:

means for creating an electric field of a direction urging transfer of a toner image from the image member to the transfer surface, means for determining the resistance of the insulating layer associated with one of the members, means for irradiating the photoconductive layer with radiation at a position at which the image member faces the transfer surface, and means for adjusting the radiation means in response to said determined resistance to adjust the response time of the applied electrical field for variations in such resistance.

12. Image forming apparatus having an image member having a photoconductive layer and a conductive layer on a transparent support, a transfer station positioned to transfer a toner image carried by the image member to a transfer surface of a receiving sheet, and a logic and control for controlling operation of the image forming apparatus, said transfer station including, a transfer member, means for applying an electrical field between the transfer member and the conductive backing of the image member, which field is of a direction urging transfer of a toner image from the image member to the receiving sheet, means for irradiating the photoconductive layer at a position at which it faces the transfer surface, said logic and control including, means for receiving an input indicative of the resistance of the receiving sheet, and means for adjusting the means for irradiating in response to said input.

* * * * *